US005433228A

United States Patent [19]

Dingler

[11] Patent Number: 5,433,228

[45] Date of Patent: Jul. 18, 1995

[54] SELF-CLEANING BEARING FLANGE FOR DISHWASHER SPRAY ARM

[75] Inventor: Geoffrey L. Dingler, St. Joseph Township, Berrien County, Mich.

[73] Assignee: Whirlpool Corporation, Benton Harbor, Mich.

[21] Appl. No.: 267,944

[22] Filed: Jul. 6, 1994

[51] Int. Cl.[6] ..... A47L 15/23

[52] U.S. Cl. ..... 134/104.1; 134/176; 239/113; 239/261

[58] Field of Search ..... 134/104.1, 144, 176, 134/179, 180, 181, 191; 239/113, 261, 264

[56] References Cited

U.S. PATENT DOCUMENTS

| | | | |
|---|---|---|---|
| 3,009,470 | 11/1961 | Zurek | 134/176 |
| 3,605,770 | 9/1971 | Robandt, II et al. | 134/179 |
| 3,876,148 | 4/1975 | Cushing et al. | 134/179 X |
| 5,131,420 | 7/1992 | Favret | 134/104.1 |

*Primary Examiner*—Philip R. Coe

*Attorney, Agent, or Firm*—Hill, Steadman & Simpson

[57] ABSTRACT

A dishwasher is provided having a rotatable spray arm. The spray arm has a circular flange for rotatably mounting the spray arm to a hub. The flange has a varying vertical contour around the hub. Food particles that may become interposed between the flange and the hub can roll out from under the flange or can be broken down in size by an up and down action caused by the flange.

20 Claims, 2 Drawing Sheets

SELF-CLEANING BEARING FLANGE FOR DISHWASHER SPRAY ARM

BACKGROUND OF THE INVENTION

This invention generally relates to dishwashers. More particularly, this invention relates to a rotatable spray arm for a dishwasher.

Dishwashers typically have a rotatable spray arm for dispensing jets of water. The jets of water are directed to spray dishes that can be loaded onto racks in the dishwasher. Typically, at least some of the jets of water are dispensed from nozzles in the spray arm which are angled so that the thrust from the jets causes the arm to rotate. Some dishwashers have both upper and lower spray arms. However, the present invention relates primarily to a lower spray arm.

A dishwasher generally has an enclosure which forms a basin at the bottom. The lower spray arm is elevated to rotate in a horizontal plane above the basin.

There are normally two racks for holding dishes. A lower rack is typically positioned just above the lower spray arm, and an upper rack is typically positioned near the top of the enclosure. If the dishwasher has an upper spray arm, the upper arm can be rotatably mounted usually below the upper rack.

The water jets wash food particles from dishes on the racks. The water and food particles then collect in the basin at the bottom of the dishwasher. Water in the basin is recirculated for washing. The water in the basin, which can contain food particles, is drained from the basin into a pump. The pump directs the water under pressure back to the spray arm nozzles.

A typical lower spray arm is rotatably mounted on a hub. The arm is typically a single, hollow component having two symmetrical members. Central to the symmetrical members is a flanged portion for mounting the arm on the hub. The hub is typically a cylindrical member which extends upwardly from the bottom of the dishwasher. The flanges are circular and shaped to fit around the hub. The hub generally has at least one port for delivering the water from the pump into the arm. The water then travels through the arm from which it exits through several nozzles.

A small gap is usually provided between each flange and the hub. The gap between each flange and the hub allows a film of water to flow between the two components. This film of water reduces friction between the flange and the hub as the arm rotates.

The water flow through the gap is desirably small so that the flange acts as a sort of seal, causing the majority of water delivered from the ports in the hub to escape through the nozzles in the spray arm. Unfortunately, food particles carried by the water can become lodged between the flange and the hub. Such lodged particles can impede the rotation of the spray arm around the hub.

A traditional flange on a dishwasher spray arm is of uniform annular shape, i.e., it has a uniform contour around the hub. Therefore, if a particle of food becomes interposed between the flange and the hub of a traditional dishwasher, the food particle could roll between the flange and the hub indefinitely as the spray arm spins.

U.S. Pat. No. 3,009,470 discloses a dishwasher having a horizontal, circular spray arm seal which has a beveled edge. A socket and pivot arrangement maintain a plane of rotation of the spray arm so that a gap is always open at the seal. An expandable coupling on the spray arm provides flow to an upper spray arm.

U.S. Pat. No. 5,131,420 discloses a dishwasher having a rotatably mounted spray arm. A pump is provided which has a centrifugal impeller and drain pump impeller mounted on a common shaft.

A need, therefore, exists for a spray arm flange that can act as a bearing and a seal, having a self-cleaning action.

SUMMARY OF THE INVENTION

The present invention provides an improved dishwasher spray arm flange that overcomes the shortcomings of the prior art. More specifically, the invention provides a spray arm flange which acts as a bearing and a seal, yet has a unique shape which provides a self-cleaning action.

To this end, the present invention provides a dishwasher spray arm configured to be mounted on a vertically disposed hub. The spray arm is mounted on the hub to rotate on a horizontal plane. An upper flange on the arm is shaped to surround the hub, forming a gap therebetween. The spray arm has a lower flange shaped to surround the hub, forming a gap therebetween. The arm can receive pressurized water between the upper flange and the lower flange from at least one port in the hub. The upper flange has a varying vertical disposition around the hub.

In an embodiment, the vertical disposition of the upper flange varies such that the upper flange has a contour angled from horizontal.

In an embodiment, the vertical disposition of the upper flange varies such that the upper flange has a rolling lower surface.

In an embodiment of the present invention, the hub has a vertically telescoping tower.

In an embodiment of the present invention, a plurality of nozzles are disposed in the spray arm for directing water out of the spray arm. At least some of the nozzles are directed at such an angle that the arm is caused to rotate.

In an embodiment of the present invention, the water is collected in a basin beneath the spray arm. The water is pumped from the basin to the hub.

In an embodiment of the present invention, a pump is provided which has a pump housing. The pump housing is configured to support the lower flange.

In another embodiment of the present invention, a dishwasher is provided comprising a cylindrical hub. A spray arm is rotatable around the hub. The spray arm has a hollow interior. The spray arm has an upper flange which is shaped to fit around the hub so that a gap is formed between the flange and the hub. The upper flange has a surface that is exposed to the interior of the spray arm. The arm also has a lower flange which is shaped to fit around the hub. At least one port is positioned in the hub between the upper flange and the lower flange. The port delivers a flow of water into the arm. The surface has a vertically-varying contour.

In an embodiment, the surface has an angled contour.

In an embodiment, the surface has a rolling contour.

It is, therefore, an advantage of the present invention to provide a dishwasher having a spray arm flange which is self-cleaning.

Another advantage of the present invention is to provide a dishwasher spray arm flange for producing a smooth operating bearing surface.

A further advantage of the present invention is to provide a dishwasher spray arm flange which provides an adequate seal.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
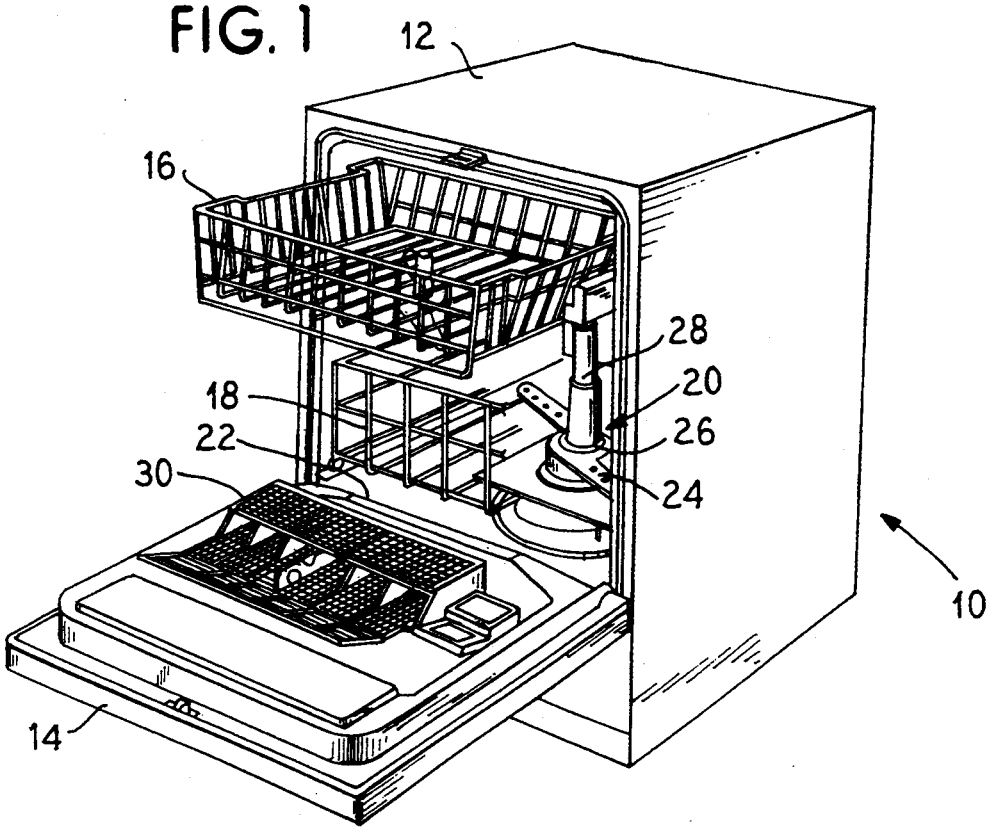
FIG. 1 illustrates a perspective view of a dishwasher.

In accordance with the invention described with reference to the accompanying figures wherein like numerals designate like parts, a dishwasher 10 is illustrated in FIG. 1. The dishwasher 10 has an enclosure 12 and a door 14. In FIG. 1, the door 14 is open, illustrating the position of a slidable upper rack 16 and a slidable lower rack 18. A portion of the lower rack 18 is broken away in FIG. 1 to reveal a spray arm assembly 20 in the bottom of the dishwasher 10.

In the bottom of the dishwasher 10, the enclosure 12 is formed into a basin 22. The spray arm assembly 20 is mounted in the basin 22, and includes a spray arm 24 rotatably mounted to a hub 26. Optionally, a telescoping spray tower 28 can be provided which is upwardly extendable from the hub 26.

A silverware rack 30 for holding silverware can be secured to the door 14. The silverware rack 30 can be of the type disclosed in U.S. Pat. No. 5,069,360 which is incorporated herein by reference. The upper rack 16 and lower rack 18 are configured and arranged so that dishes can be placed thereon for washing.

Figure 2:
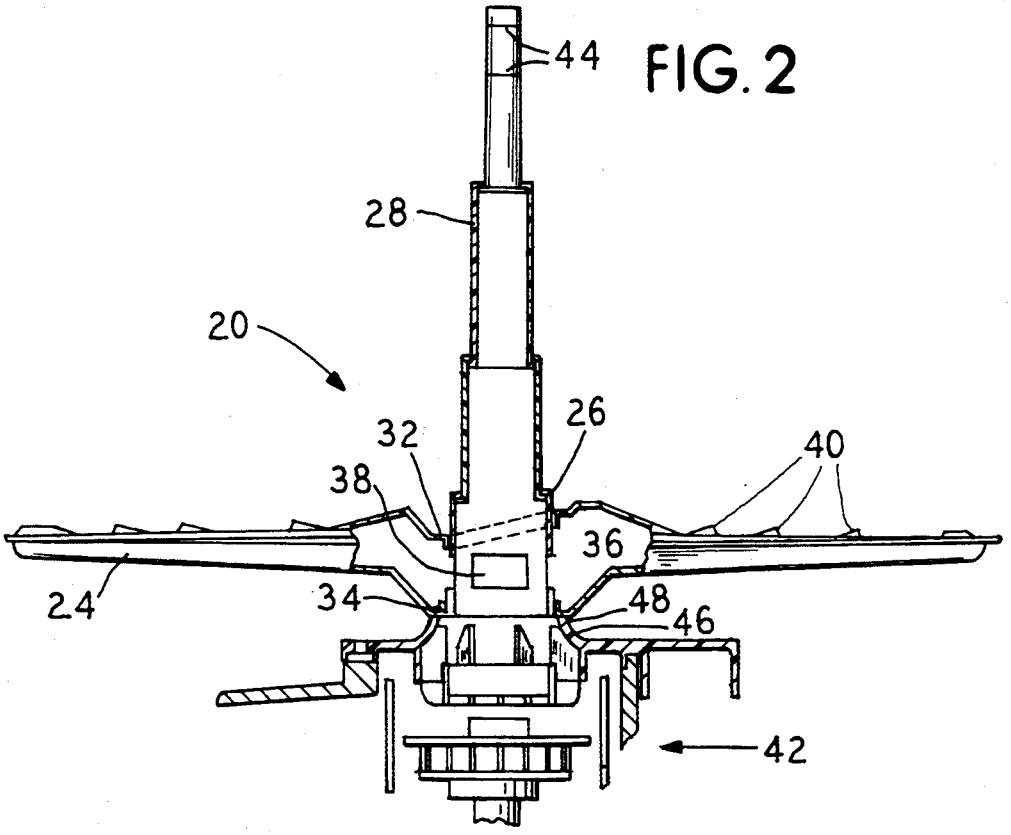
FIG. 2 illustrates a partial, sectional view of a spray arm assembly.

The spray arm assembly 20 is shown in greater detail in FIG. 2. The spray arm 24 is rotatably mounted on the hub 26. The hub 26 is cylindrical in shape. The spray arm 24 has an upper flange 32 and a lower flange 34 shaped around the hub 26. The upper flange 32 and the lower flange 34 each act as a bearing and a seal between the hub 26 and the spray arm 24.

The spray arm 24 has a hollow interior 36. The hub 26 has at least one port 38 which provides a pressurized flow of water into the interior 36. A plurality of ports 38 can be provided. A plurality of nozzles 40 are disposed along the spray arm 24.

The spray arm 24 is preferably made of stainless steel. The spray arm 24 could also be made of some other material such as plastic, so long as the material is heat-resistant. The material must be able to withstand heat radiated from a heat element (not shown) that can be positioned in the bottom of the dishwasher 10 for drying dishes after washing.

A pump 42 provides pressurized water to the hub 26. Flowing through the port 38, the pressurized water fills the interior 36 and escapes through each nozzle 40 as a spray jet. (not shown). The nozzles 40, or a portion thereof, are directed so that thrust from the spray jets will cause the spray arm 24 to rotate.

The optional telescoping spray tower 28 also fills with water. Pressure from the water causes the telescoping spray tower 28 to extend vertically. Water sprays from the tower 28 through tower nozzles 44. The telescoping spray tower 28 must be used with a lower rack 18 configured to have a hole through which the telescoping tower 28 can extend. When water pumping to the hub 26 ceases, the telescoping tower 28 collapses. The lower rack 18 can then be moved without interference from the tower 28.

The pump 42 has a pump housing 46 which is preferably formed integrally with the hub 26. The pump housing 46 forms an annular rim 48 at the base of the hub 26. The spray arm 24 is positioned so that the upper flange 32 and lower flange 34 are disposed around the hub 26, and so that the spray arm 24 rests on the rim 48.

The spray arm 24 is not forced from the hub 26 by water pressure during operation. Downward forces of thrust from the nozzles 40 and gravity keep the spray arm 24 in position. Thrust from the port 38 acts only laterally on the interior 38 of the spray arm 24 and creates no net upward force.

Figure 3:
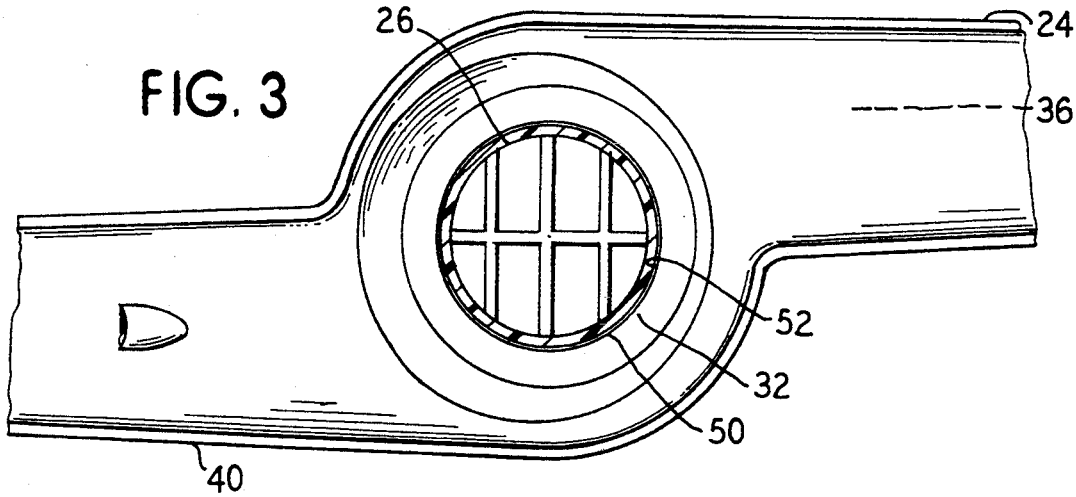
FIG. 3 illustrates a partial top view of a spray arm.

FIG. 3 illustrates the circular upper flange 32 disposed around the cylindrical hub 26. The diameter of the circular flange 32 is slightly larger than the diameter of the hub 26 so that a gap 50 is formed between the hub 26 and a bearing surface 52 of the upper flange 32. The hollow spray arm interior 36 surrounds the hub 26 so that water can freely flow from the port 38 into the interior 36 regardless of the angular position of the spray arm 24.

Figure 4:
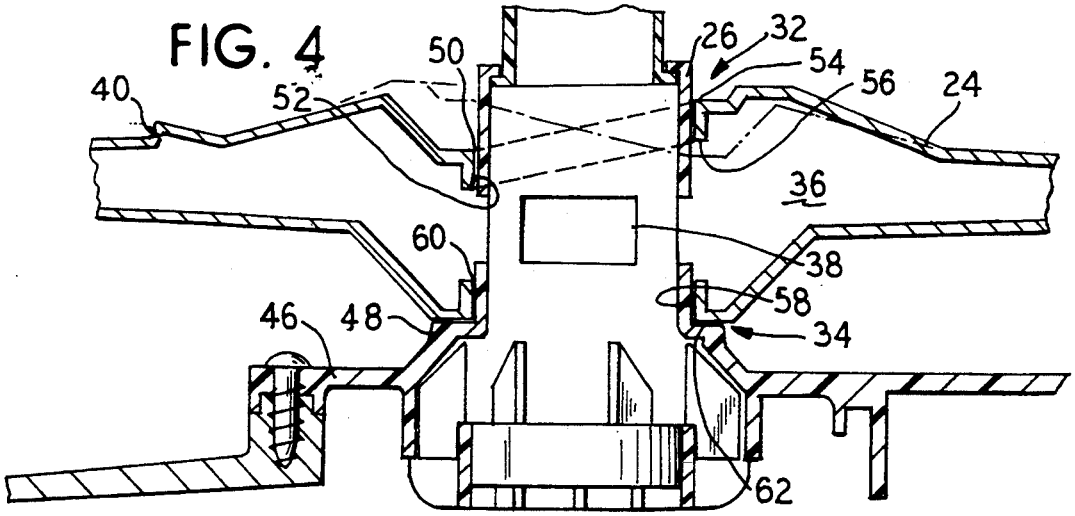
FIG. 4 illustrates a partial, sectional side view of a spray arm assembly.

FIG. 4 illustrates a configuration of the upper flange 32 in accordance with the present invention. The bearing surface 52 of the upper flange 32 is generally aligned with the hub 26. The upper flange 32 also has an upper surface 54 and a lower surface 56, each of which lies generally in a plane that is not horizontal. Therefore, points on the upper flange 32 vary in vertical position around the hub 26. As a result, points on the hub 26 which are in the region of the upper flange 32 are alternately covered and uncovered by the upper flange 32 as the spray arm rotates on the hub due to the changing relative position of the upper flange 32 and the hub.

Figure 5:
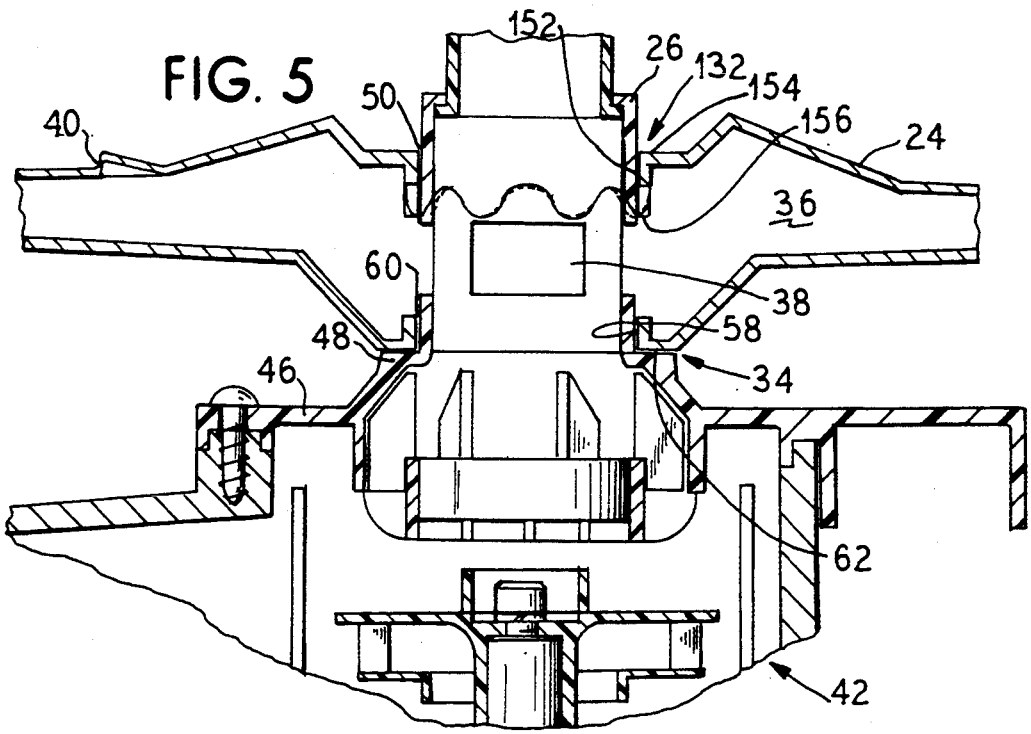
FIG. 5 illustrates a partial, sectional side view of an alternative embodiment of a spray arm assembly.

FIG. 5 illustrates an alternative embodiment of the present invention. In this embodiment, the upper flange 132 also has a bearing surface 152 separated from the hub by a gap 50. This embodiment, however, has a lower surface 156 which is sinusoidal or rolling in shape and an upper surface 154 that is horizontal.

The lower flange 34 of the spray arm 24 is also illustrated in FIGS. 4 and 5 in greater detail. The lower flange 34 has a bearing surface 58 which is separated from the hub 26 by a gap 60. A bottom surface 62 of the lower flange 34 rests on the pump housing 46 when the hub 26 is not delivering pressurized water. When the hub 26 is delivering water, a film of water can fill the gap 60 and can separate the bottom surface 62 from the pump housing 46.

The inventive configuration of the upper flange 32 and 132 as shown in FIGS. 4 and 5 prevents the lodging of food particles in the gap 50. As a result, there is less friction between the spray arm 24 and the hub 26.

Food particles can be carried by the water because the dishwasher 10 recirculates wash water. The water sprayed on dishes from the nozzles 40 collects in the basin 22. The pump 42 receives the water from the basin 22 and delivers it under pressure to the hub 26 and through the port 38. Most of the water delivered through the port 38 travels through the spray arm 24 from which the water exits through the nozzles 40.

However, some of the water flows thorough the gaps 50 and 60.

The water in the gaps 50 and 60 acts as a friction-reducing film. The gaps are sized so that flow through the gaps is small. Food particles in the water can become interposed in the gap 50 between the upper flange 32, 132 and the hub 26. When this occurs, a small food particle can simply flow through the gap 50 with the film of water. A larger food particle, however, tends to lodge between the flange 32, 132 and the hub 26.

Because the flange 32, 132 rotates, a lodged particle rolls horizontally in the gap 50. An upper flange 32, 132 that is vertically-irregular, as in FIGS. 4 and 5, helps such food particles to roll out from the gap 50 to be washed away. Also, a food particle in the spray arm interior 36 can tend to move up or down with the vertically-irregular lower surface 56, 156, reducing the size of a particle until it is small enough to flow through the gap. This improves the performance of the spray arm 24 by reducing rotational friction.

It should be understood that various changes and modifications to the presently preferred embodiments described herein will be apparent to those skilled in the art. Such changes and modifications may be made without the parting from the spirit and scope of the present invention and without diminishing its attendant advantages. For instance, the contour of the upper flange 32, 132 can be almost any vertically-irregular shape, i.e., a saw-tooth, step, zig-zag or other contour could be used. It is, therefore, intended that such changes and modifications be covered by the appended claims.

The embodiments of the invention in which an exclusive property or privilege is claimed are therefore defined as follows:

1. 1. A dishwasher spray arm configured to be mounted on a vertically disposed hub to rotate in a horizontal plane;

said spray arm having an upper flange shaped to surround said hub, forming a gap therebetween;

said spray arm having a lower flange positioned so that said spray arm can receive pressurized water from at least one port in said hub between said upper flange and said lower flange;

wherein said upper flange has a varying vertical disposition around said hub.

2. A dishwasher spray arm according to claim 1 wherein said vertical disposition of said upper flange is such that said upper flange has a contour angled from horizontal.

3. A dishwasher spray arm according to claim 1 wherein said vertical disposition of said upper flange is such that said upper flange has a rolling lower surface.

4. A dishwasher spray arm according to claim 1 configured for use with said hub wherein said hub has a vertically telescoping tower.

5. A dishwasher spray arm according to claim 1 further comprising a plurality of nozzles in said spray arm for directing said water out of said spray arm, wherein at least some of said nozzles are directed at such an angle that said arm is caused to rotate.

6. A dishwasher spray arm according to claim 1 wherein said spray arm is made of steel.

7. A dishwasher according to claim 1 further comprising a pump for pumping water to said hub, said pump having a pump housing configured to support said lower flange.

8. A dishwasher comprising:

a cylindrical hub;

a spray arm that is rotatable around said hub, said spray arm having a hollow interior;

an upper flange on said arm, said upper flange shaped to fit around said hub so that a gap is formed between the flange and the hub;

a surface of said upper flange being exposed to said interior;

a lower flange on said arm, said lower flange shaped to fit around said hub;

at least one port in said hub positioned between said upper flange and said lower flange for delivering a flow of water into said arm; and wherein said surface has a vertically-varying contour.

9. A dishwasher according to claim 8 wherein said surface has an angled contour.

10. A dishwasher according to claim 8 wherein said surface has a rolling contour.

11. A dishwasher according to claim 8 further comprising a plurality of nozzles in said spray arm wherein one or more of said nozzles are directed at an angle for causing said spray arm to rotate.

12. A dishwasher according to claim 8 further comprising:

a basin; and a pump for pumping water from said basin to said hub.

13. A dishwasher according to claim 12 wherein said hub extends upwardly from said pump.

14. A dishwasher according to claim 13 wherein said pump has a pump housing from which said hub extends upwardly, said pump housing being configured to support said lower flange.

15. A dishwasher comprising:

a basin for collecting water;

a cylindrical hub extending upwardly from said basin;

a pump for pumping water from said basin into said hub; a spray arm having a hollow interior being configured to receive water from said hub into said hollow interior; and a flange on said spray arm for rotatably mounting said spray arm to said hub, said flange being separated from said hub by a gap, wherein said flange has a nonuniform vertical disposition around said hub.

16. A dishwasher according to claim 15 wherein said non-uniform vertical disposition is generally a non-horizontal plane.

17. A dishwasher according to claim 15 wherein said non-uniform vertical disposition is sinusoidal.

18. A dishwasher according to claim 15 further comprising a lower flange on said spray arm wherein said lower flange surrounds said hub and said water is received into said spray arm interior between said flange and said lower flange.

19. A dishwasher according to claim 15 further comprising at least one port in said hub for providing a flow of water into said spray arm interior.

20. A dishwasher according to claim 15 further comprising a telescoping spray tower that is extendable from said hub.

* * * * *